US008514153B2

(12) United States Patent
Kohno et al.

(10) Patent No.: US 8,514,153 B2
(45) Date of Patent: Aug. 20, 2013

(54) IMAGING DEVICE AND METHOD OF CORRECTION PIXEL DETERIORATION THEREOF

(75) Inventors: Tohru Kohno, Kokubunji (JP); Mitsuhide Miyamoto, Kawasaki (JP); Hajime Akimoto, Kokubunji (JP); Naruhiko Kasai, Yokohama (JP); Masato Ishii, Tokyo (JP)

(73) Assignees: Hitachi Displays, Ltd., Chiba-ken (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 797 days.

(21) Appl. No.: 12/219,202

(22) Filed: Jul. 17, 2008

(65) Prior Publication Data

US 2009/0027314 A1 Jan. 29, 2009

(30) Foreign Application Priority Data

Jul. 23, 2007 (JP) ..... 2007-191282

(51) Int. Cl.
*G09G 3/30* (2006.01)

(52) U.S. Cl.
USPC ..... 345/77; 345/76

(58) Field of Classification Search
USPC ..... 345/76, 77
See application file for complete search history.

(56) References Cited

U.S. PATENT DOCUMENTS 6,496,168 B1 * 12/2002 Tomida ..... 345/76
7,012,586 B2 3/2006 Kageyama et al.
7,215,307 B2 5/2007 Ochi et al.
7,245,277 B2 7/2007 Ishizuka
2005/0110720 A1 * 5/2005 Akimoto et al. ..... 345/76

FOREIGN PATENT DOCUMENTS

JP 2002-341825 5/2001
JP 2002-351403 A 12/2002
JP 2005-156697 11/2003
JP 2004-004759 A 1/2004

(Continued)

OTHER PUBLICATIONS

Office Action issued from Japanese Patent Office in corresponding Japanese Patent Application No. 2007-191282, dated Feb. 21, 2012.

*Primary Examiner* — Alexander Eisen
*Assistant Examiner* — Mark Regn
(74) *Attorney, Agent, or Firm* — Stites & Harbison PLLC; Juan Carlos A. Marquez, Esq.; Sgtephen J. Weyer, Esq.

(57) ABSTRACT

In a display mode, a signal driving circuit (DAC) transmits image signals to the pixels selected by a scanning circuit for display and first switches of switch units. Then, a power supply circuit supplies a current corresponding to the transmitted signal to the pixels. Then, organic EL elements provided in the pixels are driven to emit light, thereby displaying an image. In order to correct the deterioration of the organic EL elements, first, a constant current flows from a current source to the organic EL elements of the pixels selected by a scanning circuit for detection and second switches and a voltage corresponding to the constant current applied to the organic EL element is detected. The detected voltage is input to an AD converter through a buffer amplifier, and the AD converter converts the voltage into a digital value, and transmits the digital value to a signal correction control unit. When the organic EL element deteriorates, the detected digital value varies. Therefore, the signal correction control unit corrects the signal from the signal driving circuit, thereby correcting the deterioration of the organic EL element.

9 Claims, 13 Drawing Sheets

(56) References Cited

FOREIGN PATENT DOCUMENTS

| | | | | |
|---|---|---|---|---|
| JP | 2004-045647 | A | | 2/2004 |
| JP | 2005-134435 | A | | 5/2005 |
| JP | 2006091709 | A | * | 4/2006 |
| KR | 10-2007-0028166 | | * | 3/2007 |

* cited by examiner

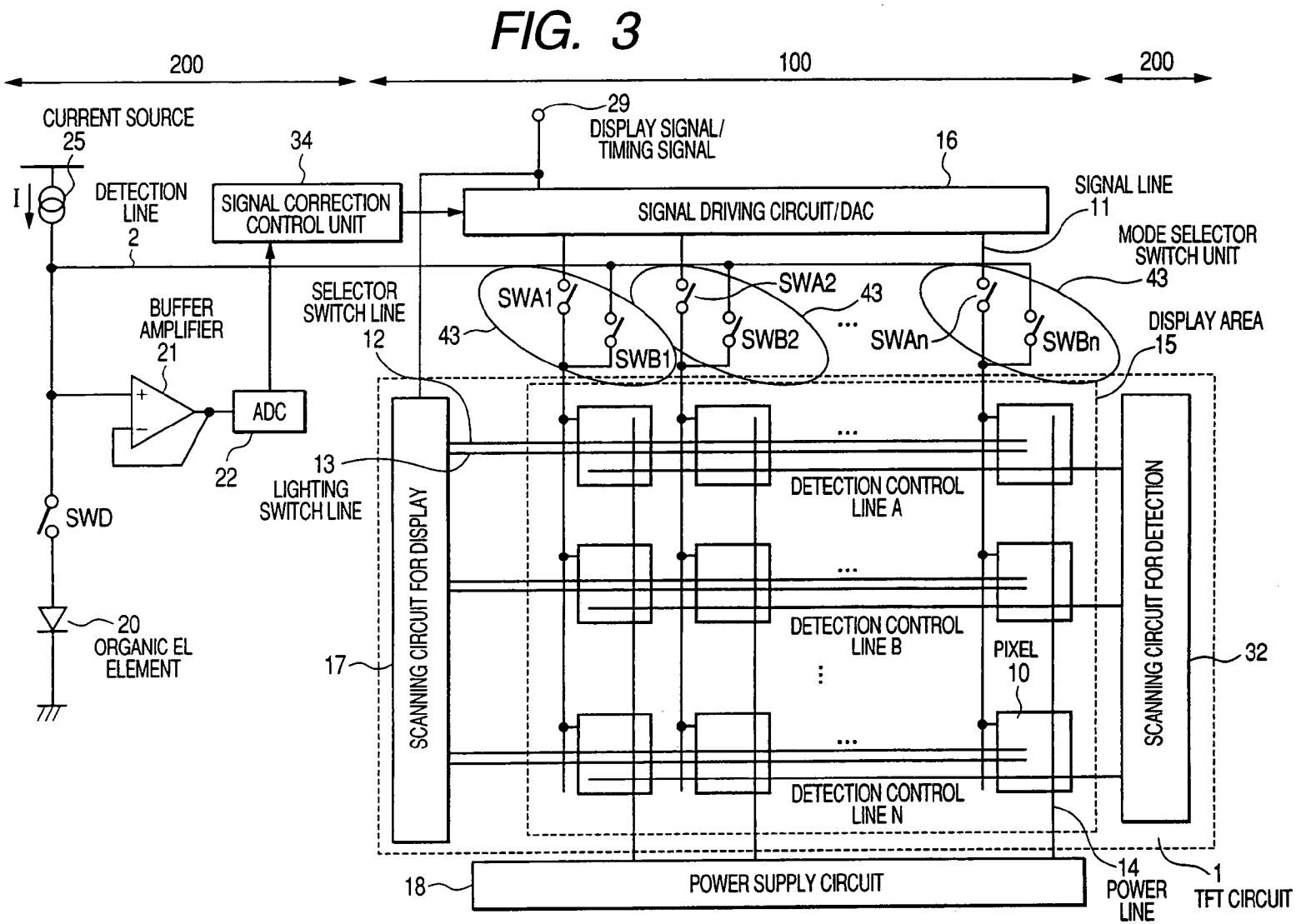
FIG. 3
200
100
200
SIGNAL LINE
11
MODE SELECTOR SWITCH UNIT
43
DISPLAY AREA
15
32
TFT CIRCUIT
1
SCANNING CIRCUIT FOR DETECTION
14
POWER LINE
SWBn
SWAn
PIXEL
10
16
SIGNAL DRIVING CIRCUIT/DAC
43
SWA2
SWB2
SWB1
SWA1
DETECTION CONTROL LINE A
DETECTION CONTROL LINE B
DETECTION CONTROL LINE N
POWER SUPPLY CIRCUIT
29
DISPLAY SIGNAL/ TIMING SIGNAL
43
SCANNING CIRCUIT FOR DISPLAY
18
SELECTOR SWITCH LINE
12
13
LIGHTING SWITCH LINE
17
34
SIGNAL CORRECTION CONTROL UNIT
ADC
22
BUFFER AMPLIFIER
21
CURRENT SOURCE
25
DETECTION LINE
2
SWD
20
ORGANIC EL ELEMENT

IMAGING DEVICE AND METHOD OF CORRECTION PIXEL DETERIORATION THEREOF

CLAIM OF PRIORITY

The present application claims priority from Japanese patent application JP 2007-191282 filed on Jul. 23, 2007, the content of which is hereby incorporated by reference into this application.

FIELD OF THE INVENTION

The present invention relates to an imaging device using a display panel having self-emission elements arranged in a matrix, and more particularly, to an imaging device capable of detecting the deterioration of self-emission elements and correcting irregularity in brightness, thereby improving image quality, and a method of correcting pixel deterioration thereof.

BACKGROUND OF THE INVENTION

Imaging devices using self-emission display panels having pixels composed of self-emission elements, such as organic EL elements (which are also referred to organic light emitting diodes (OLEDs)), have been put to practical use. The imaging device using the self-emission display elements has high visibility and a high response speed and does not require an auxiliary illuminating device, such as a backlight of a liquid crystal display device. The organic EL element, which is a typical example of a current-driven self-emission display element, deteriorates due to variation in characteristics over time or logical high-brightness display over a long period of time (burn-in occurs), such that a local reduction in brightness occurs, which causes a remarkable difference in brightness between adjacent pixels, resulting in irregularity in the brightness of a display image. In the imaging device using the organic EL elements as the pixels, it is necessary to correct the irregular brightness due to the deterioration of the organic EL elements. A technique for detecting the deterioration of the organic EL elements and correcting the irregular brightness has been proposed in JP-A-2005-156697 and JP-A-2002-341825.

SUMMARY OF THE INVENTION

In JP-A-2005-156697 and JP-A-2002-341825, in order for an organic EL display panel to stably emit light without burn-in occurring, the results measured by an ammeter are converted into digital data, and then the obtained digital data is fed back to driving signals for the organic EL elements. Since deterioration, that is, burn-in occurs locally, a deterioration detecting process is performed for each pixel or in the minimum unit of pixels. Therefore, the number of detecting processes increases, and the time required for the detecting process increases. As a result, the operation efficiency of the products becomes lowered, which causes the usability of products to be reduced.

FIG. 1 is a diagram illustrating variation in current-voltage characteristics due to the deterioration of the organic EL element. In FIG. 1, the horizontal axis indicates a voltage [V], and the vertical axis indicates current destiny [mA/cm$^2$] required for predetermined brightness display. When the organic EL element deteriorates, as shown in FIG. 1, the I-V characteristics of the element vary from characteristic curve 1 to characteristic curve 2 as represented by an arrow. The reason is that the resistance of the organic EL element increases since a voltage value corresponding to a current required for predetermined brightness display increases due to the deterioration of the organic EL element.

FIG. 2 is a diagram illustrating a variation in the voltage of the organic EL element with time. In FIG. 2, the horizontal axis indicates time [s], and the vertical axis indicates a voltage [V]. When a constant current is continuously applied to the organic EL element, the organic EL element deteriorates with time, and the voltage value of the organic EL element increases as represented by characteristic curve 3 in FIG. 2. In the above-mentioned process of correcting the deterioration of the organic EL element, the level of the voltage which is elevated due to the applied current is detected, and information of the detected voltage level is fed back to a correction signal generating unit.

An object of the invention is to provide an imaging device capable of shortening the time required to detect the deterioration of organic EL elements and improving operating efficiency, and a method of correcting pixel deterioration thereof.

The object is achieved by detecting a voltage on the basis of a current value of a reference organic EL element, using the detected voltage as a reference voltage, and feeding back the difference between the reference voltage and the voltage of the organic EL element forming a pixel to a signal driving circuit to correcting a display signal supplied to the organic EL element of the deteriorated pixel.

According to an aspect of the invention, an imaging device includes: a display unit that includes a display area in which a plurality of pixels composed of self-emission elements are arranged in a matrix, a scanning circuit for display, a signal driving circuit, and a power supply circuit; a deterioration detecting and correcting unit that includes a scanning circuit for detection, detects a correction reference voltage, and feeds back the detected value to the signal driving circuit to correct display signals to be transmitted to deteriorated pixels; and mode selector switch units that selectively connect the signal driving circuit and the deterioration detecting and correcting unit to the display area.

According to the above-mentioned aspect of the invention, it is possible to shorten the time required to detect the deterioration of organic EL elements forming pixels and thus improve the operating efficiency of an imaging device.

BRIEF DESCRIPTION OF THE DRAWINGS

FIG. 3 is a diagram illustrating the structure of a display panel provided with an element deterioration correcting system in an imaging device according to first embodiment of the invention;

DETAILED DESCRIPTION OF THE PREFERRED EMBODIMENTS

Figure 1:
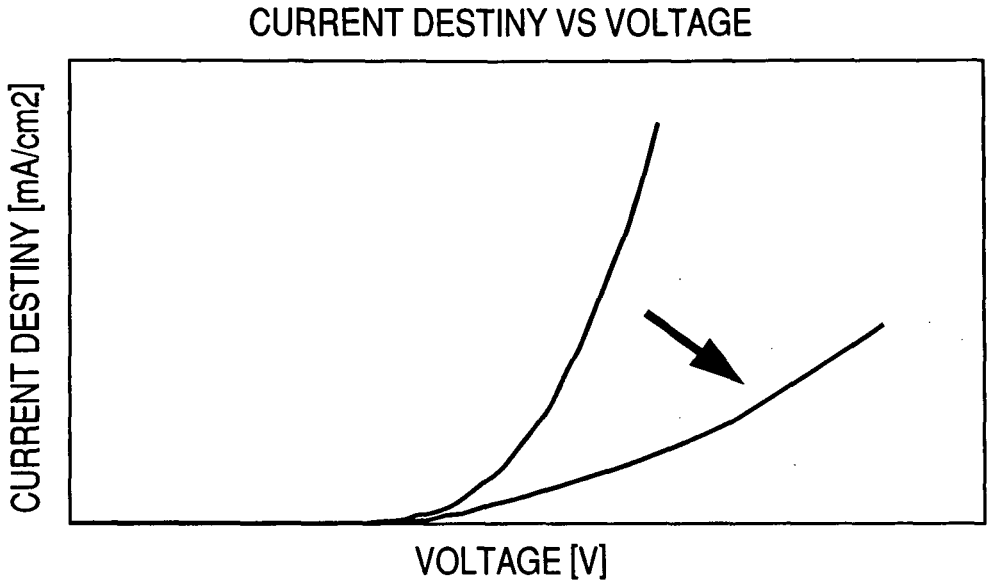
FIG. 1 is a diagram illustrating a variation in current-voltage characteristics due to the deterioration of organic EL elements.
Figure 2:
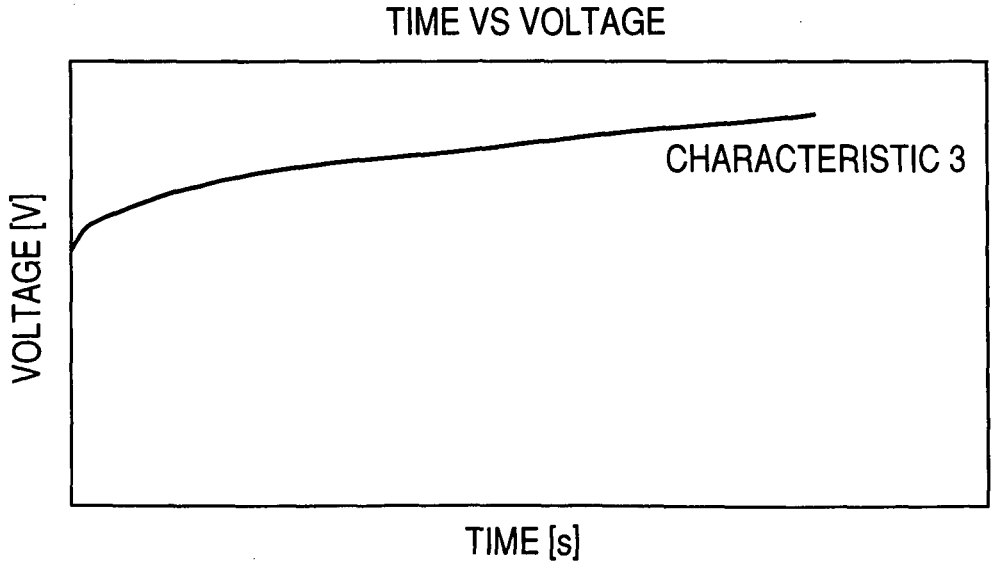
FIG. 2 is a diagram illustrating variation in the voltage of the organic EL element over time.

Hereinafter, exemplary embodiments of the invention will be described in detail with reference to the accompanying drawings.

First Embodiment

FIG. 3 is a diagram illustrating the structure of a display panel provided with an element deterioration correcting system in an imaging device according to a first embodiment of the invention. In FIG. 3, the imaging device includes a display unit 100 and a detecting/correcting unit 200. The display unit 100 has a display area 15 in which pixels 10 composed of organic EL elements are arranged in a matrix. A signal driving circuit 16 (which includes a digital-to-analog converter (DAC), and is represented by a signal driving circuit/DAC in FIG. 3) that supplies display signals to the pixels, a scanning circuit 17 for display, a power supply circuit 18, and a scanning circuit 32 for detection that forms the deterioration detecting and correcting unit 200 are provided in the periphery of the display area 15. The display signals and timing signals 29 are input from an external signal source (host) to the signal driving circuit 16 and the scanning circuit 17 for display. In this structure, the display area 15, the scanning circuit 17 for display, the power supply circuit 18, the scanning circuit 32 for detection form a thin film transistor (TFT) circuit that is formed on a glass substrate (not shown).

Signal lines 11 extend from the signal driving circuit 16 to the display area 15 through switches SWA1, SWA2, . . . , SWAn of mode selector switch units 43, through which the display signals are supplied to the pixels. Selector switch lines 12 and lighting switch lines 13 extend from the scanning circuit 17 for display to the display area 15 in order to select and turn on the pixels 10. Power lines 14 extend from the power supply circuit 18 to the display area 15 in order to supply a current to the pixels such that the organic EL elements emit light.

The deterioration detecting and correcting unit 200 includes a reference organic EL element 20, a buffer amplifier 21, an analog-to-digital converter (ADC) 22, a current source 25, a signal correction control unit 34, and a switch SWD that is turned on first during a test. In addition, the signal lines 11 are selectively connected to the current source 25 by switches SWB1, SWB2, . . . , SWBn of the mode selector switch units 43.

In the structure, in a general display mode, the signal driving circuit 16 transmits image signals to the pixels selected by the scanning circuit 17 for display and the switches SWA1, SWA2, . . . , SWAn of the mode selector switch units 43. Then, the power supply circuit 18 supplies a current corresponding to the transmitted signal to the pixels 10. The organic EL element provided in each pixel is driven to emit light, thereby displaying an image.

In order to detect and correct the deterioration of the organic EL element, first, all of the mode selector switch units 43 are turned off, and a detection line 2 is disconnected from the signal lines 11 and the signal driving circuit 16. In this state, the switch SWD is turned on to supply a current from the current source 25 to the organic EL element 20. A voltage corresponding to the current is applied to the input of the buffer amplifier 21. This voltage is a reference voltage. Then, the switches SWB1, SWB2, . . . , SWBn of the mode selector switch units 43 are turned on to connect the detection line 2 to the signal lines 11, and the scanning circuit 32 for detection sequentially selects a detection control line A, a detection control line B, . . . , a detection control line N. The current source 25 applies a constant current to the organic EL element of each of the pixels selected by the scanning circuit 32 for detection and the switches SWB1, SWB2, . . . , SWBn of the mode selector switch units 43, thereby detecting a voltage corresponding to the constant current from the organic EL element.

The detected voltage is input to the AD converter (ADC) 22 through the buffer amplifier 21, and the converter (ADC) 22 converts the voltage value into a digital value and transmits the digital value to the signal correction control unit 34. When the organic EL element deteriorates, there is a difference between the detected digital value and the reference voltage. The signal correction control unit 34 controls the signal driving circuit 16 to correct the display signals to be output to the signal lines 11, on the basis of the difference between the voltages. When the switches SWA1, SWA2, . . . , SWAn of the mode selector switch units 43 are turned on, in the display mode, the signal driving circuit 16 supplies the corrected display signals to the corresponding pixels through the signal lines 11. The signal driving circuit 16 makes pixel driving digital data using its digital-to-analog converter (DAC). In this way, the deterioration of the organic EL elements of the corresponding pixels is corrected.

Figure 4:
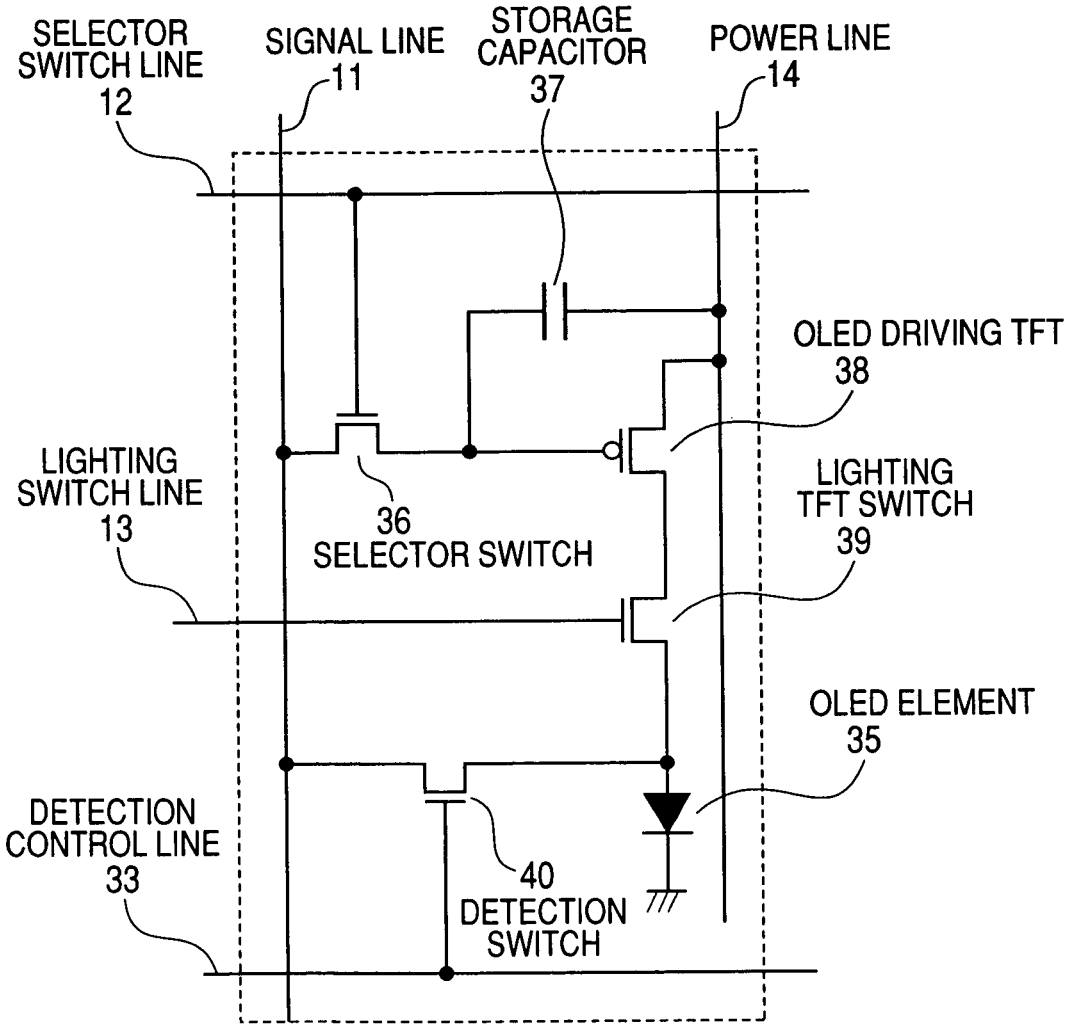
FIG. 4 is a circuit diagram illustrating a first example of the circuit structure of a pixel formed in a display area of the display panel shown in FIG. 3.

FIG. 4 is a circuit diagram illustrating a first example of the circuit structure of the pixel formed in the display area of the display panel shown in FIG. 3. The pixel shown in FIG. 4 is formed by connecting an organic EL element (OLED element) 35, a selector switch 36, a storage capacitor 37, an OLED driving TFT 38, a lighting TFT switch 39, and a detection switch 40, as shown in FIG. 4.

The pixel circuit is obtained by adding the detection switch 40 to the most common voltage-programmed pixel circuit. During the display of an image (in the display mode), the detection switch 40 is always turned off. In the display mode, first, the selector switch 36 is turned on, and the lighting TFT switch 39 is turned off. Then, a display voltage (display data) is written from the signal driving circuit 16 to the storage capacitor 37 that is connected to a gate electrode of the OLED driving TFT 38. Then, the selector switch 36 is turned off, and the lighting TFT switch 39 is turned on to supply a current to the organic EL element 35 through the power line 14 such that the organic EL element 35 emits light. Meanwhile, in a deterioration detecting/correcting mode, only the detection switch 40 is turned on to detect characteristics of the organic EL element 35.

Figure 5:
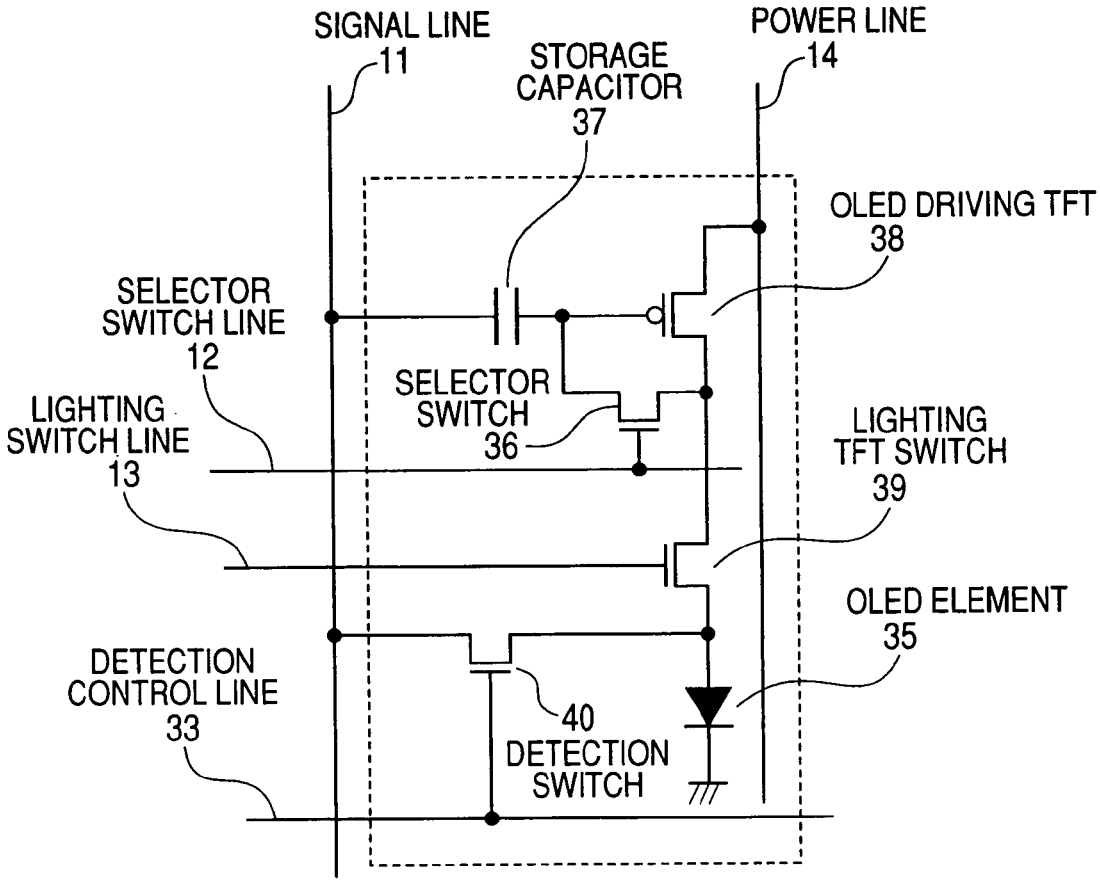
FIG. 5 is a circuit diagram illustrating a second example of the circuit structure of the pixel formed in the display area of the display panel shown in FIG. 3.

FIG. 5 is a circuit diagram illustrating a second example of the circuit structure of the pixel formed in the display area of the display panel shown in FIG. 3. FIG. 5 shows a voltage-programmed pixel circuit for cancelling variation in the characteristics of a thin film transistor (TFT). In the display mode, similar to the circuit shown in FIG. 4, the detection switch 40 is always turned off. First, the selector switch 36 is turned on and the lighting TFT switch 39 is turned off to store a voltage obtained by subtracting a threshold value Vth of the OLED driving TFT 38 from the power supply voltage in the storage capacitor 37 that is connected to the gate electrode of the OLED driving TFT 38 as an image signal voltage supplied to the signal line 11.

This operation cancels a variation in the threshold value Vth of the TFT. Then, the selector switch 36 is turned off and the lighting TFT switch 39 is turned on to apply a current to the OLED element 35 such that the OLED element 35 emits light. Meanwhile, in the deterioration detecting/correcting mode, similar to the circuit shown in FIG. 4, only the detection switch 40 is turned on to detect characteristics of the organic EL element 35.

Figure 6A:
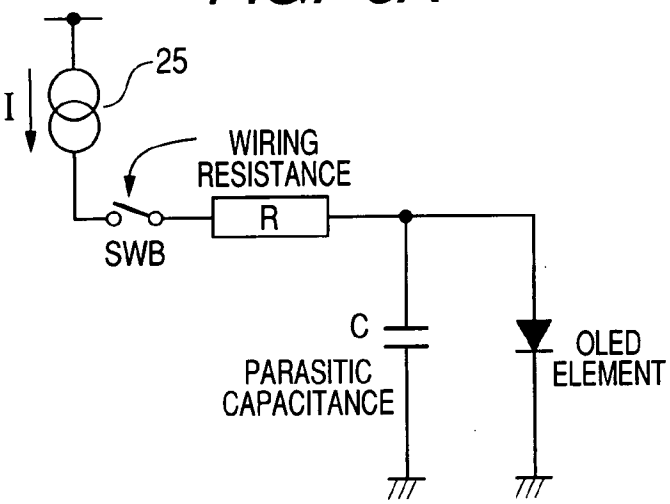
FIG. 6A is a circuit diagram illustrating a path for detecting the deterioration of the organic EL display panel according to the first embodiment of the invention.
Figure 6B:
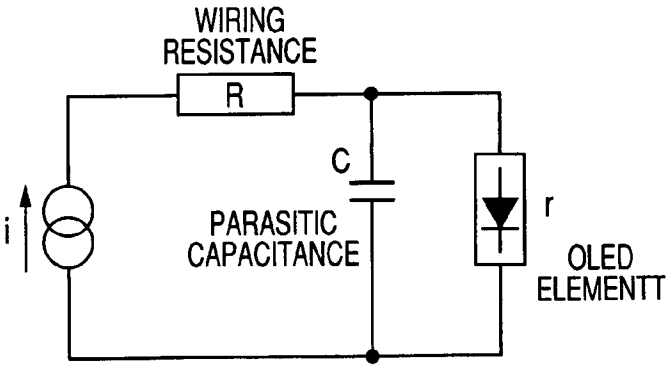
FIG. 6B is an equivalent circuit diagram of FIG. 6A.
Figure 6C:
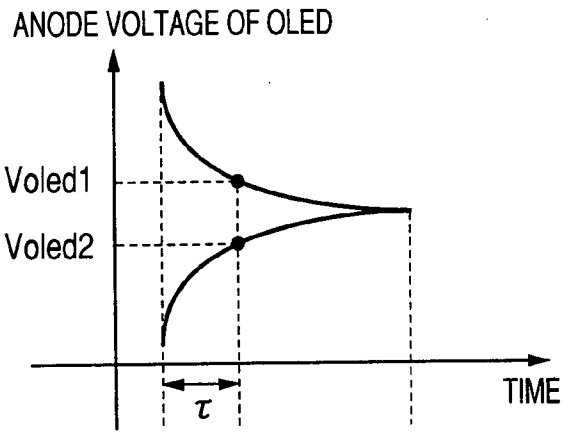
FIG. 6C is a diagram illustrating the converged waveform of a detected voltage.

FIGS. 6A to 6C are a circuit diagram of a path for detecting the deterioration of the organic EL display panel according to the first embodiment of the invention, an equivalent circuit diagram thereof, and a diagram illustrating the waveform of a detected voltage, respectively. Since an object of the invention is to shorten the detection time of the detecting operation of the deterioration correcting system, the invention is focused on only the operation of the deterioration correcting system detecting the characteristics of the organic EL element. FIG. 6A is a circuit diagram illustrating a path for detecting the OLED elements of the pixels selected by the scanning circuit 32 for detection and the switches SWB1, SWB2, . . . , SWBn of the mode selector switch units 43 shown in FIG. 4.

A switch SWB of the mode selector switch unit 43 is any one of the switches SWB1, SWB2, . . . , SWBn shown in FIG. 3. When the switch SWB is turned on, as shown in FIG. 6A, the current source 25 and the OLED element are connected to each other. Since the on resistance of the switch SWB or the detection switch 40 shown in FIGS. 4 and 5 is considerably smaller than the resistance of the OLED element, the on resistance is negligible. In addition, the wiring resistance R and the parasitic capacitance C of the signal line are incorporated into this model.

FIG. 6B shows a small signal equivalent circuit at the time when the switch SWB is turned on in the circuit shown in FIG. 6A. In FIG. 6B, 'i' indicates a variation in the amount of current (an AC signal) when the switch SWB is turned on. When the resistance of the OLED element is represented by 'r', $(dq/dt)+(q/rR)=i$ is satisfied in the circuit shown in FIG. 6B. Therefore, the convergence time of the variation in current, that is, a time constant $\tau$ for the convergence of the detected voltage is represented by $r\times C$. When the voltage is detected at the time constant $\tau$, about 60% of the converged voltage is detected. Therefore, as represented by Voled1 and Voled2 in FIG. 6C, when the difference between the initial voltages is large, a difference is detected in the voltage. In order to make the detected voltage constant, a time constant of $3\times\tau$ to $5\times\tau$ needed, which results in an increase in detection time.

Figure 7:
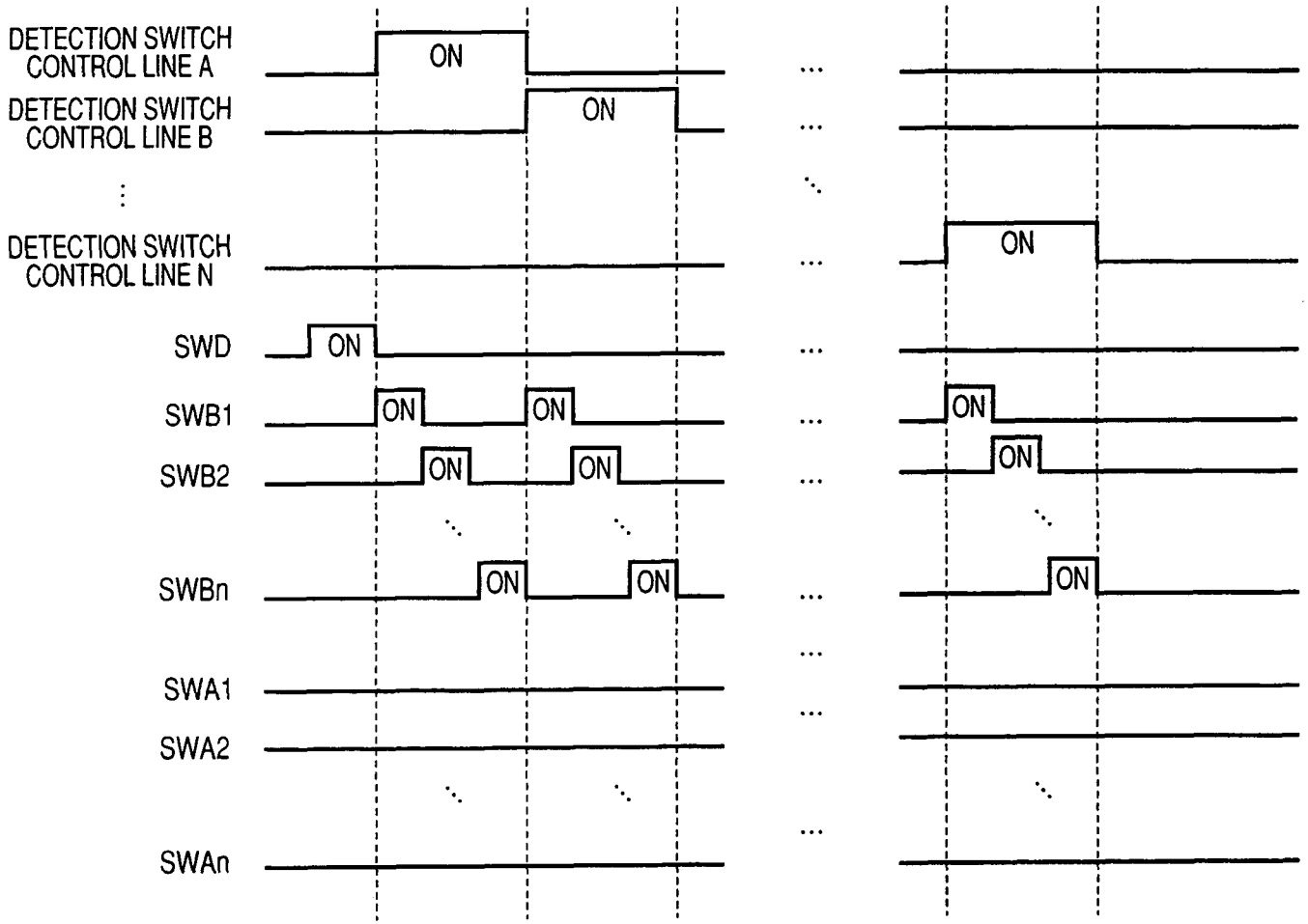
FIG. 7 is a driving waveform diagram during a detecting operation according to the related art, which is compared with the invention.

FIG. 7 is a driving waveform diagram during a detecting operation according to the related art, which is compared with the invention. FIG. 7 shows the waveforms of the corresponding components shown in FIG. 3. The switches SWB1, SWB2, . . . , SWBn of the mode selector switch units 43 are sequentially selected while the switches SWA1, SWA2, . . . , SWAn of the mode selector switch units 43 are all turned off, and then the organic EL elements of the pixels are monitored. The initial value of the detected voltage depends on the brightness of light from the pixel during the display of an image. Therefore, the time required to turn on each of the switches SWB1, SWB2, . . . , SWBn should be long enough to ensure $3\times\tau$ to $5\times\tau$ in order to make the detected voltage constant. As a result, in the related art, the total detection time increases, and the usability of products becomes lowered.

Figure 8:
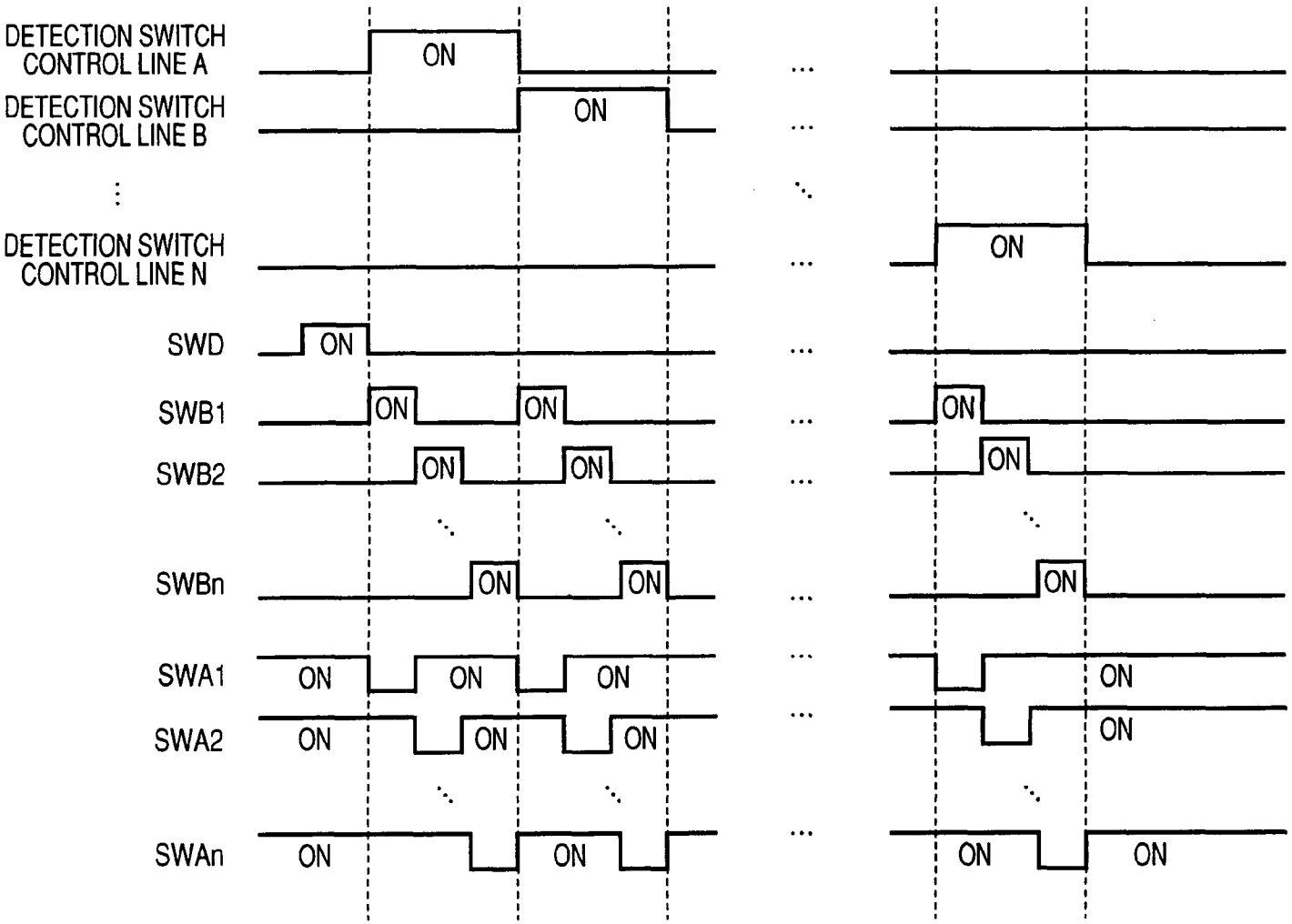
FIG. 8 is a diagram illustrating a first example of the waveforms of driving signals during a detecting operation according to the first embodiment of the invention.

FIG. 8 is a diagram illustrating a first example of the waveforms of driving signals during a detecting operation according to the first embodiment of the invention. FIG. 8 shows the waveforms of the corresponding components shown in FIG. 3. This embodiment of the invention performs the driving operation shown in FIG. 8 in order to shorten the time required to detect the deterioration of the organic EL element and improve the usability of products. First, the switch SWD shown in FIG. 3 is turned on to supply a current from the current source 25 to the organic EL element 20, which is a reference element for detection, thereby detecting the voltage of the terminal of the organic EL element 20, and the AD converter (ADC) 22 converts the detected voltage into a digital signal. Then, the digital signal is input to the signal correction control unit 34. The signal correction control unit 34 stores the digital signal as detection reference data.

Then, the switches SWA1, SWA2, . . . , SWAn of the mode selector switch units 43 are turned on to charge the signal lines 11 with the detected voltage from the signal driving circuit (DAC) 16. The signal driving circuit (DAC) 16 converts the detected voltage into an analog signal, and transmits the analog signal to the signal lines 11. This is called pre-charging.

Then, the scanning circuit 32 for detection performs sequential scanning and the switches SWB1, SWB2, . . . , SWBn of the mode selector switch units 43 are sequentially selected, thereby monitoring the pixels. However, since each of the signal lines 11 is pre-charged with the detected voltage, the detected voltage is made constant without requiring the detection time. In this way, the detected voltage seems to be converged to a predetermined level in a short time, and it is possible to determine the deterioration of the pixels, depending on the accuracy of the AD converter (ADC) 22, even when the detection time is shorter than the time constant $\tau$. As a result, it is possible to shorten the total detection time.

Further, as shown in FIG. 8, it is possible to shorten the detection time by repeatedly turning on or off the switches SWA1, SWA2, . . . , SWAn and the switches SWB1, SWB2, . . . , SWBn, which are LSI switches, while turning on the detection switches 40 (see FIGS. 4 and 5) in the pixels 10 by the detection control lines A, B, . . . , N. The detection switch 40 in the pixel 10 is formed of a thin film transistor (TFT). Since the gate width of the TFT is larger than that of the LSI, the switches are set such that the switching operation of the LSI switch having a small variation in voltage during the charge injection is more frequent than that of the TFT.

Figure 9:
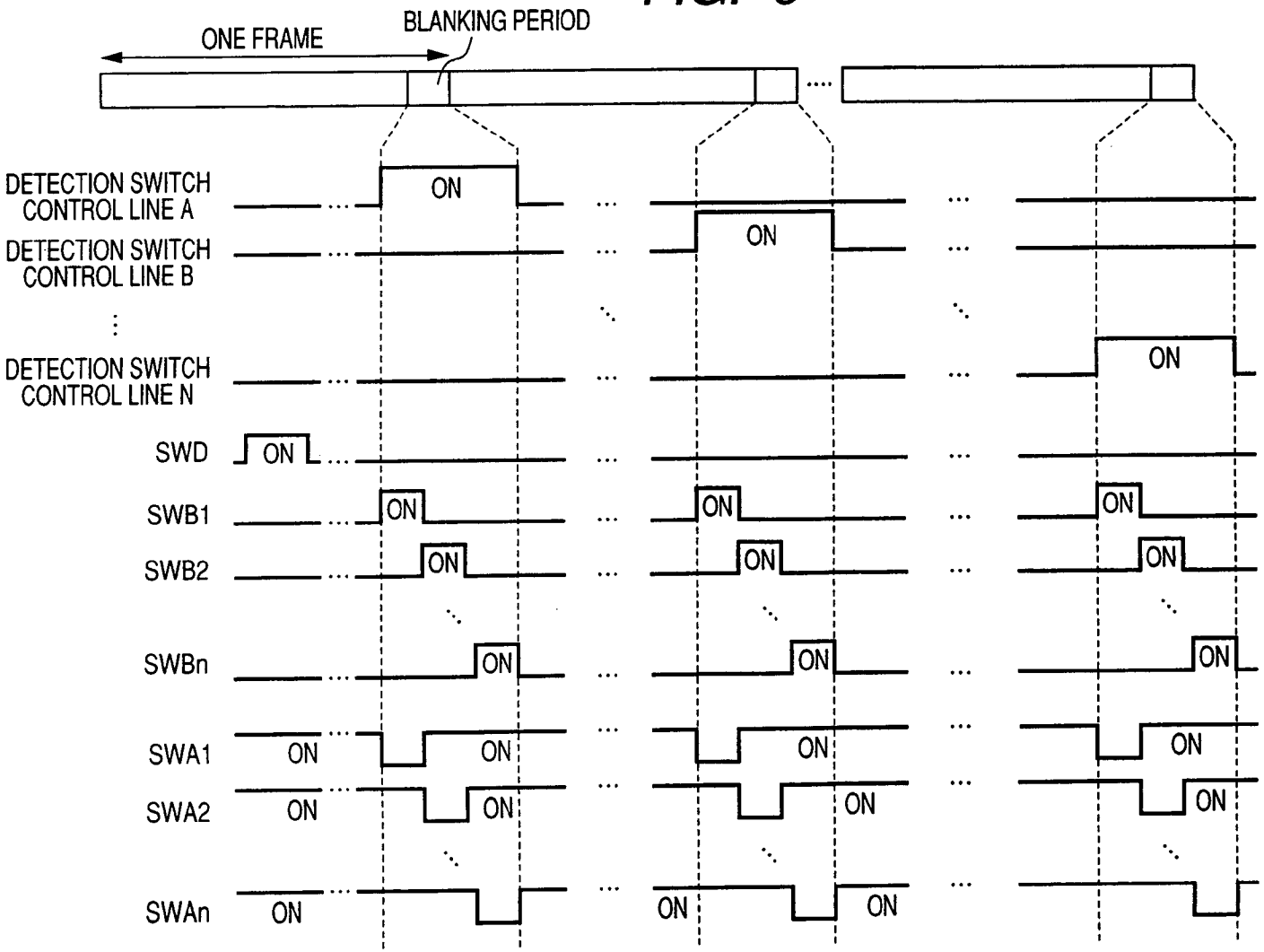
FIG. 9 is a diagram illustrating a second example of the waveforms of driving signals during the detecting operation according to the first embodiment of the invention.

FIG. 9 is a diagram illustrating a second example of the waveforms of driving signals during the detecting operation according to the first embodiment of the invention. FIG. 9 shows an example of detecting the deterioration of the organic EL element of each pixel for every one horizontal period within the blanking period of an image signal. The second example is basically similar to the first example shown in FIG. 8, and pre-charging makes it possible to shorten the time required to detect the deterioration. For example, it is possible to detect the deterioration for the time corresponding to about one tenth of one frame.

Figure 10:
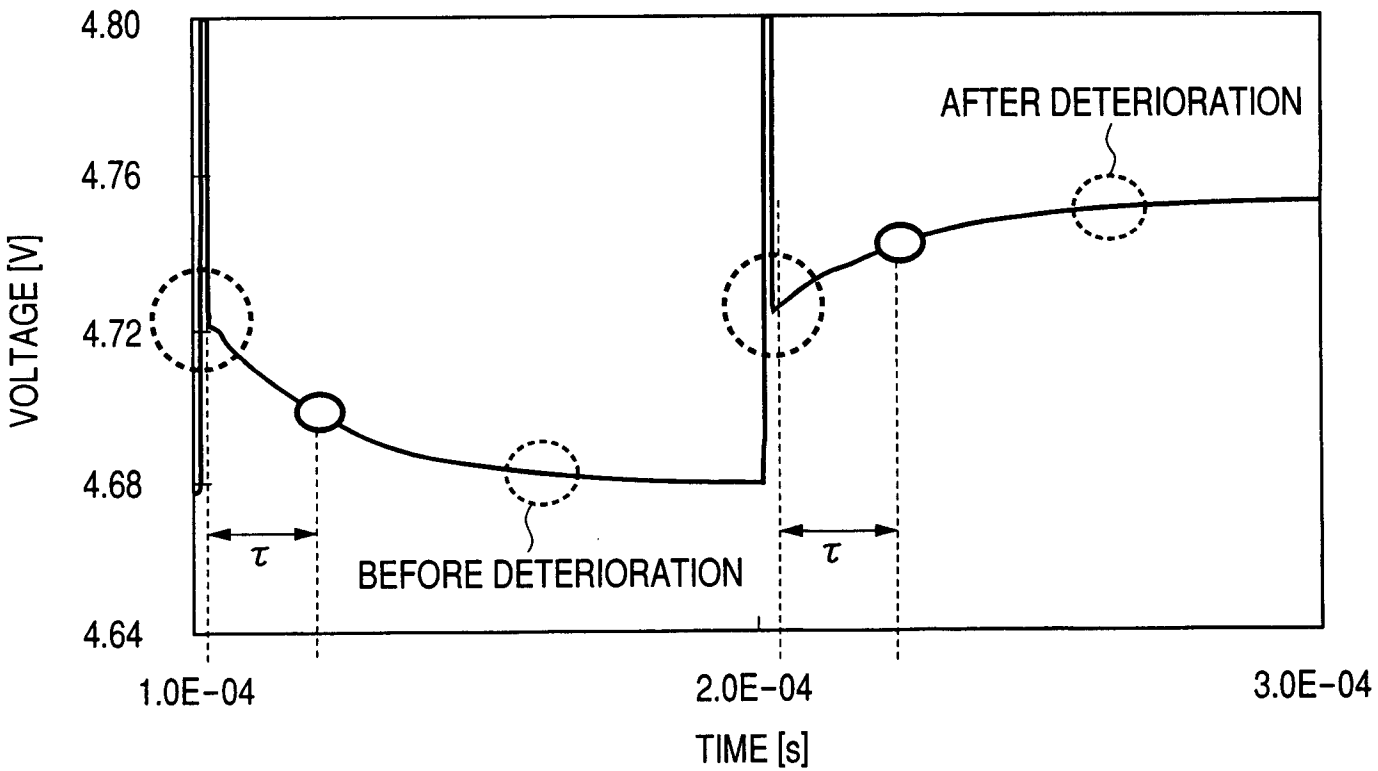
FIG. 10 is a diagram illustrating the effects of shortening the detection time of the organic EL display panel according to the first embodiment of the invention.

FIG. 10 is a diagram illustrating the effects of shortening the detection time of the organic EL display panel according to the first embodiment of the invention. FIG. 10 shows the converged waveforms of the detected voltage before and after the pixel deteriorates when the pre-charge voltage is 4.72 V. Since an initial voltage is 4.72 V, all the elements have the converged waveform shown in FIG. 10 even when the initial voltage becomes inconstant due to, for example, the image signal during a detecting operation. If the voltage difference is larger than a voltage indicating one bit of the ADC 22 shown in FIG. 3, it is determined that the pixel deteriorates. For example, when the difference between the detected voltages before and after the pixel deteriorates is about 40 mV and one bit of the ADC 22 is equal to or lower than 40 mV at the time constant $\tau$ after the detecting operations starts, it is possible to detect the deterioration at the time constant $\tau$.

According to the first embodiment, it is possible to shorten the time required to detect the deterioration of the organic EL element and improve the operating efficiency of an imaging device.

Second Embodiment

Figure 11:
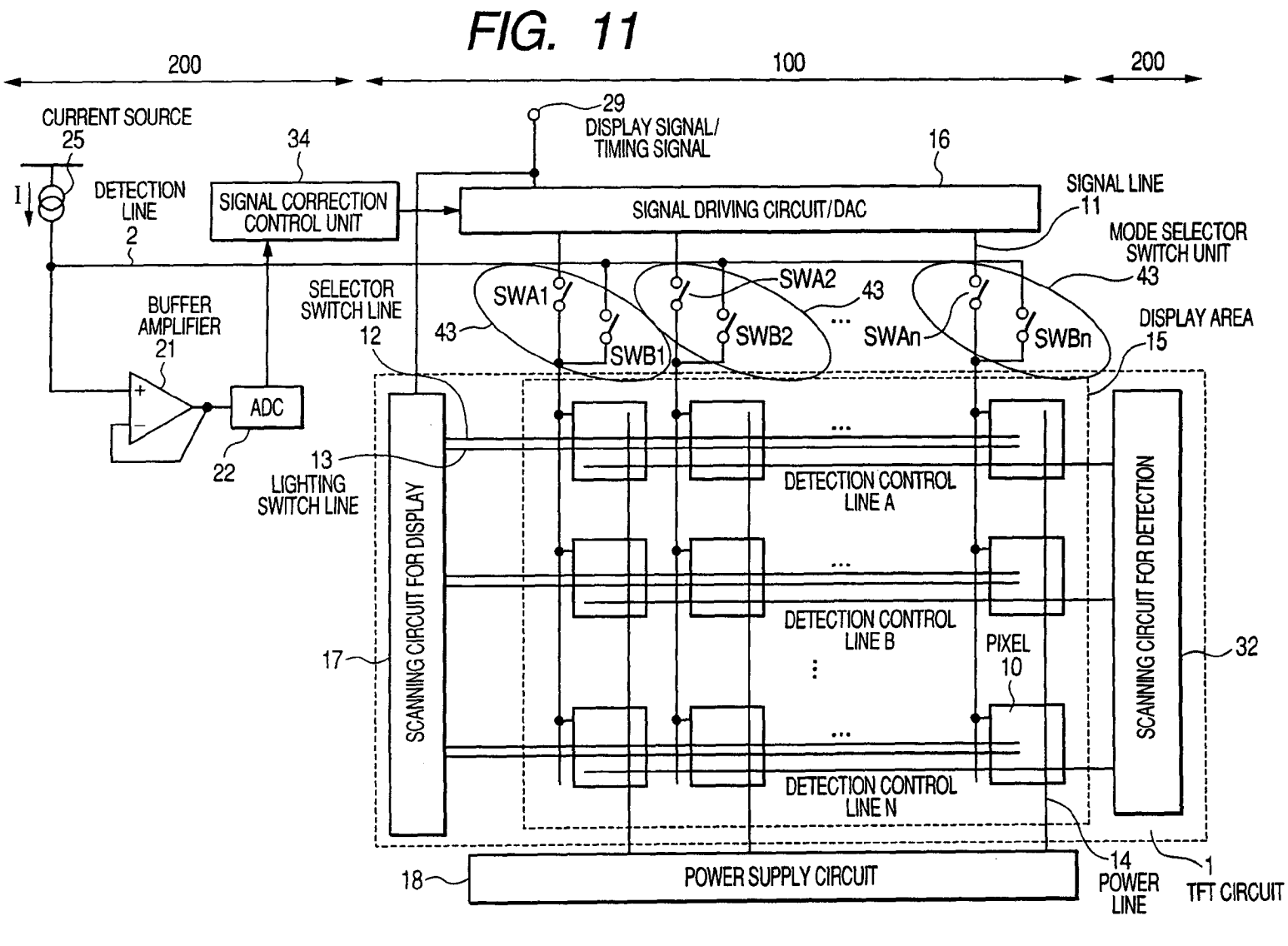
FIG. 11 is a diagram illustrating the structure of a display panel provided with an element deterioration correcting system in an imaging device according to a second embodiment of the invention.

FIG. 11 is a diagram illustrating the structure of a display panel provided with an element deterioration correcting system in an imaging device according to a second embodiment of the invention. In the first embodiment shown in FIG. 3, a pixel, which is a criterion for determining a pre-charge voltage, is provided outside the display unit. However, in the second embodiment, an OLED element for determining the pre-charge voltage is provided as an element of a pixel in a panel display unit. The second embodiment differs from the first embodiment shown in FIG. 3 in that the switch SWD and the organic EL element connected to the switch SWD are not provided. In FIG. 11, the same components as those in FIG. 3 have the same functions. Since all operations except a detecting operation are the same as those in the first embodiment, a description thereof will be omitted.

Figure 12:
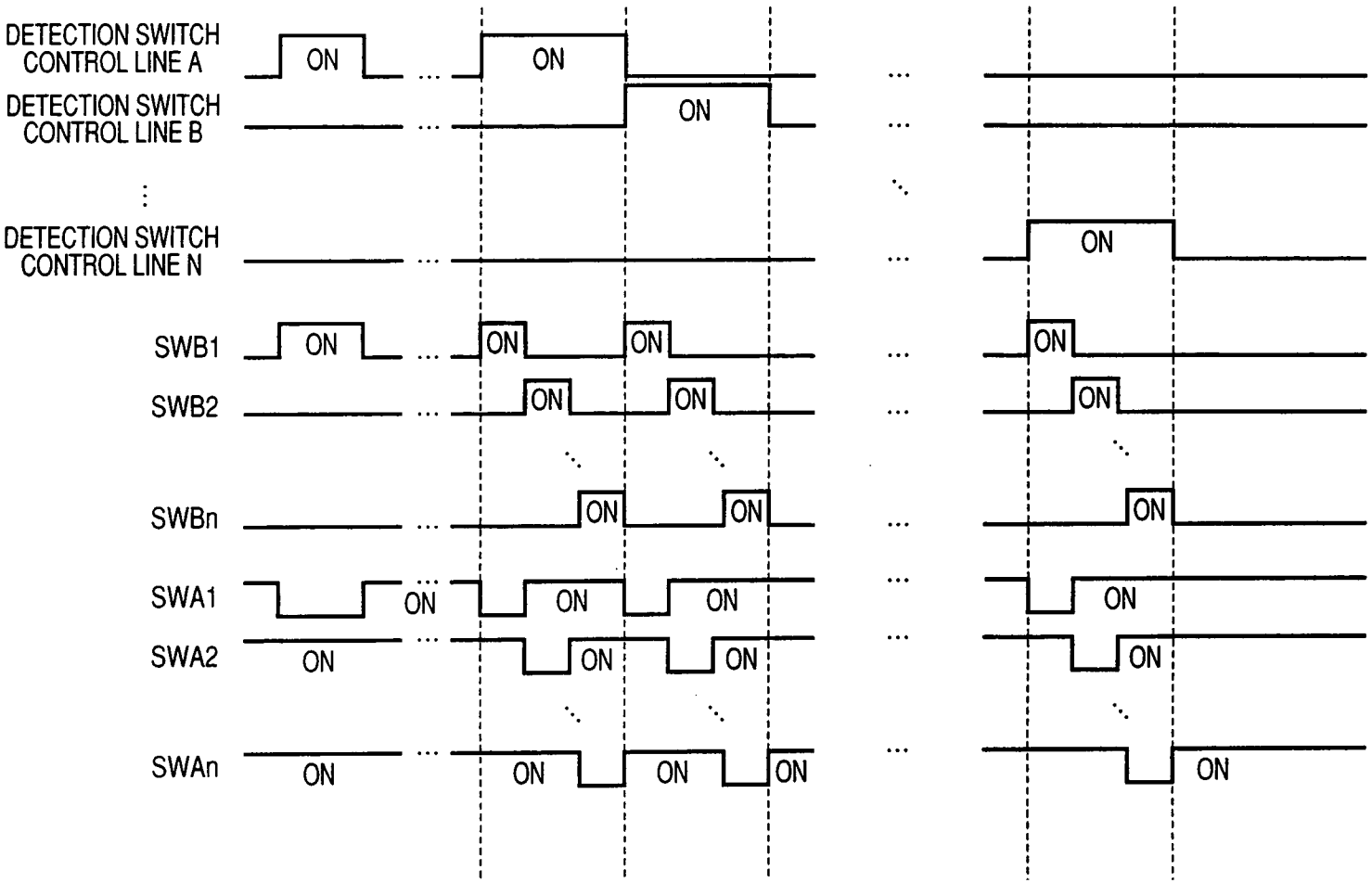
FIG. 12 is a driving waveform diagram of a pixel deterioration detecting operation of the organic EL display panel according to the second embodiment of the invention shown in FIG. 11.

FIG. 12 is a driving waveform diagram of a pixel deterioration detecting operation of the organic EL display panel according to the second embodiment of the invention shown in FIG. 11. As shown in FIG. 12, only the element, which is a criterion for determining the pre-charge voltage, takes a long detection time. The other operations are the same as those in the first embodiment.

According to the second embodiment, it is also possible to shorten the time required to detect the deterioration of the organic EL element and improve the operating efficiency of an imaging device.

Figure 13B:
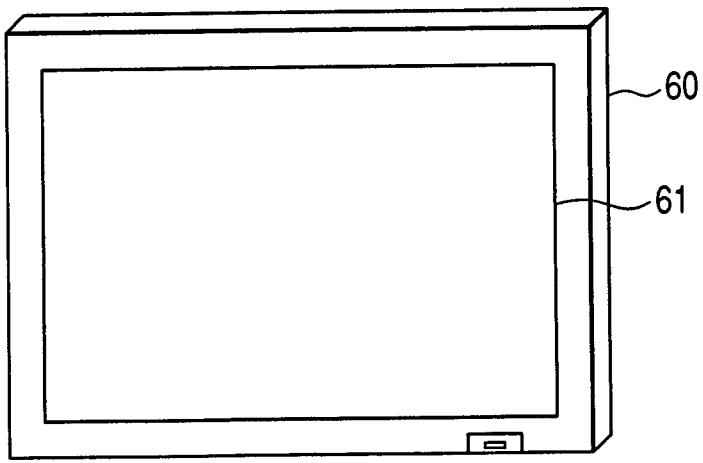
FIGS. 13A and 13B are diagrams illustrating detailed examples of an electronic apparatus equipped with the imaging device according to the invention.
Figure 13A:
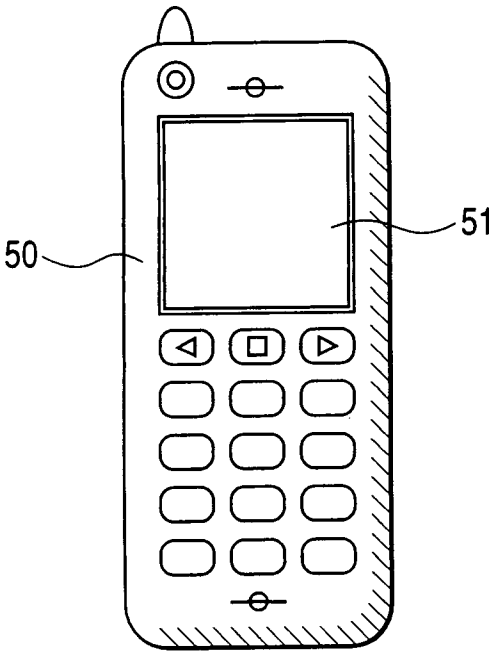
Figure 14B:
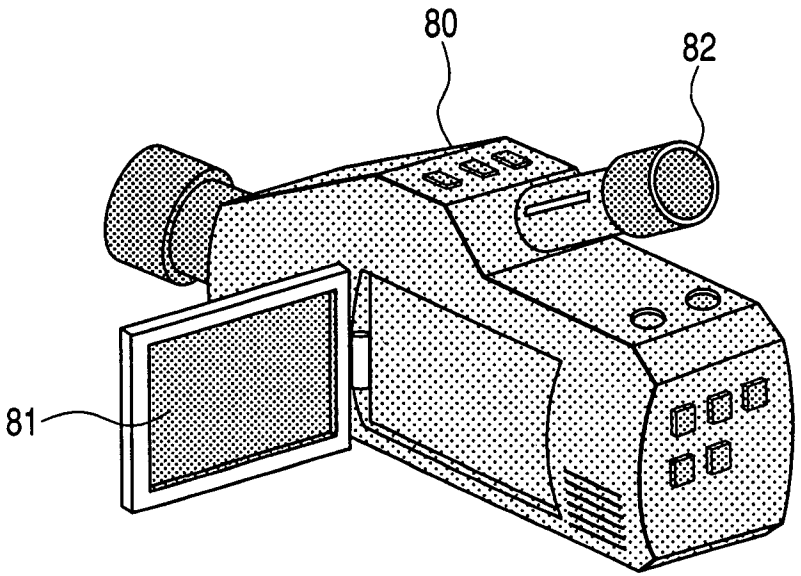
FIGS. 14A and 14B are diagrams illustrating detailed examples of the electronic apparatus equipped with the imaging device according to the invention.
Figure 14A:
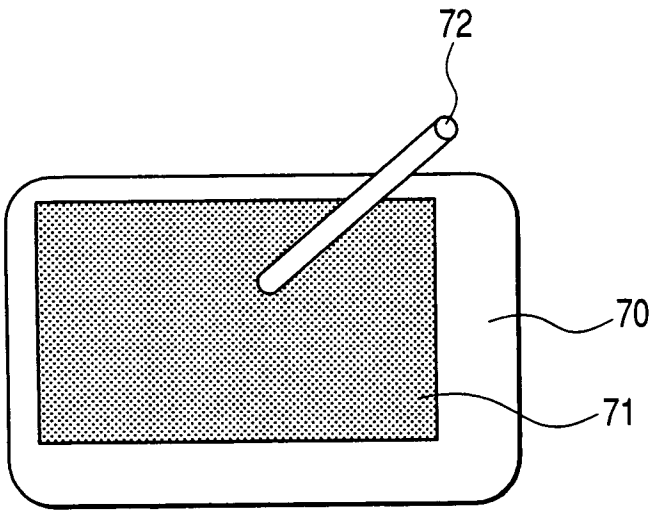

FIGS. 13A and 13B and FIGS. 14A and 14B are diagrams illustrating detailed examples of an electronic apparatus equipped with the imaging device according to the invention. FIG. 13A shows a mobile phone 50 having the imaging device according to the invention as a display unit 51. FIG. 13B shows a television set 60 having the imaging device according to the invention as a display unit 61. FIG. 14A shows a portable information terminal 70 having the imaging device according to the invention as a display unit 71. The portable information terminal 70 is also called a personal digital assistant (PDA) and a touch sensor is provided in the display unit such that a user can use an input stick 72 to manually input information. FIG. 14B shows a video camera 80 having the imaging devices according to the invention as a monitor display unit 81 and an electronic finder 82.

The electronic apparatuses provided with the imaging device according to the invention can shorten the time required to detect the deterioration of organic EL elements. As a result, it is possible to provide products having high usability.

What is claimed is:

1. An imaging device comprising:

a display unit that includes a display area in which a plurality of pixels composed of self-emission elements are arranged in a matrix, a scanning circuit for display, a signal driving circuit, and a power supply circuit;

a deterioration detecting and correcting unit that includes a scanning circuit for detection, detects a correction reference voltage, and feeds back the detected value to the signal driving circuit to correct display signals to be transmitted to deteriorated pixels;

signal lines that extend from the signal driving circuit to the display area and supply a display signal voltage to the pixels arranged in a column direction of the matrix; and mode selector switch units that selectively connect the signal driving circuit and the deterioration detecting and correcting unit to the signal lines, wherein each of the plurality of pixels includes a detection switch which is turned on in case of detecting deterioration of the self-emission elements between the self-emission elements and corresponding one of the signal lines, and wherein the mode selector switch units connects the signal lines and the deterioration detecting and correcting unit in case of detecting deterioration of the self-emission elements, and wherein, when the detection switch is turned on so as to connect the self-emission elements with corresponding one of the signal lines, the deterioration detecting and correcting unit detects a voltage of the self-emission elements through the corresponding one of the signal lines.

2. The imaging device according to claim 1, wherein the display unit includes:

selector switch lines and lighting switch lines that extend from the scanning circuit for display to the display area and select the pixels arranged in a row direction of the matrix; and power lines that extend from the power supply circuit to the display area and supply a current to the pixels, and wherein the deterioration detecting and correcting unit includes:

a scanning circuit for detection;

detection control lines that extend from the scanning circuit for detection to the display area and select the pixels arranged in the row direction of the matrix;

a current source;

a reference self-emission element that is connected in series to the current source with a switch interposed therebetween and has the same structure as the self-emission elements;

a detection line that connects a node between the current source and the switch to the mode selector switch units; and a signal correction control unit that applies, to the signal driving circuit, signals for correcting the deterioration of the display signals supplied to the pixels on the basis of detection signals transmitted through the detection line;

wherein each of the plurality of pixels further includes a lighting switch which is turned off in case of detecting deterioration of the self-emission elements between the self-emission elements and the power supply circuit.

3. The imaging device according to claim 2, wherein each of the mode selector switch units includes:

a first switch that is turned on or off between the signal driving circuit and the signal line; and a second switch that is turned on or off between the detection line and the signal line, and wherein the first switch and the second switch are exclusively turned on or off.

4. The imaging device according to claim 2, wherein a series circuit of a buffer amplifier and an analog-to-digital converter is provided between the detection line and the signal correction control unit.

5. The imaging device according to claim 1, wherein the display unit includes:

selector switch lines and lighting switch lines that extend from the scanning circuit for display to the display area and select the pixels arranged in a row direction of the matrix;

power lines that extend from the power supply circuit to the display area and supply a current to the pixels, and wherein the deterioration detecting and correcting unit includes:

a scanning circuit for detection;

detection control lines that extend from the scanning circuit for detection to the display area and select the pixels arranged in the row direction of the matrix;

a current source;

a detection line that connects the current source and the mode selector switch units; and a signal correction control unit that applies, to the signal driving circuit, signals for correcting the deterioration of the display signals supplied to the pixels on the basis of detection signals transmitted through the detection line; and each of the plurality of pixels further includes a lighting switch which is turned off in case of detecting deterioration of the self-emission elements between the self-emission elements and the power supply circuit.

6. The imaging device according to claim 5, wherein each of the mode selector switch units includes:

a first switch that is turned on or off between the signal driving circuit and the signal line; and a second switch that is turned on or off between the detection line and the signal line, and wherein the first switch and the second switch are exclusively turned on or off.

7. The imaging device according to claim 5, wherein a series circuit of a buffer amplifier and an analog-to-digital converter is provided between the detection line and the signal correction control unit.

8. A method of correcting the deterioration of pixels of an imaging device, the imaging device including: a display unit that includes a display area in which a plurality of pixels composed of self-emission elements and detection switches are arranged in a matrix, a scanning circuit for display, a signal driving circuit, and a power supply circuit; a deterioration detecting and correcting unit that includes a scanning circuit for detection, detects a correction reference voltage and feeds back the detected value to the signal driving circuit to correct display signals to be transmitted to deteriorated pixels; and mode selector switch units that selectively connect the signal driving circuit and the deterioration detecting and correcting unit to the display area, the display unit including: selector switch lines and lighting switch lines that extend from the scanning circuit for display to the display area and select the pixels arranged in a row direction of the matrix; signal lines that extend from the signal driving circuit to the display area and supply a display signal voltage to the pixels arranged in a column direction of the matrix; and power lines that extend from the power supply circuit to the display area and supply a current to the pixels, and the deterioration detecting and correcting unit including: the scanning circuit for detection; detection control lines that extend from the scanning circuit for detection to the display area and select the pixels arranged in the row direction of the matrix; a current source; a reference self-emission element that is connected in series to the current source with a switch interposed therebetween and has the same structure as the self-emission elements; a detection line that connects a node between the current source and the switch to the mode selector switch units; and a signal correction control unit that applies, to the signal driving circuit, signals for correcting the deterioration of the display signals supplied to the pixels on the basis of detection signals transmitted through the detection line, the method comprising:

in an image display mode of the display unit, operating the mode selector switch units to connect the signal lines to the signal driving circuit, thereby supplying the display signals from the signal driving circuit to the pixels to display an image;

in a pixel deterioration detecting/correcting mode of the display unit, operating the mode selector switch units to disconnect the signal lines from both the signal driving circuit and the detection line;

turning on the switch that is connected in series to the reference self-emission element to supply a constant current from the current source to the reference self-emission element;

detecting a voltage corresponding to the current as a reference voltage;

turning off the switch that is connected in series to the reference self-emission element to disconnect the reference self-emission element from the current source;

connecting the signal lines to the current source to supply the constant current from the current source to the pixels selected by the scanning circuit for detection;

turning on the detection switch of one of the pixels so as to connect the self-emission elements with corresponding one of the signal lines;

detecting a voltage corresponding to the current;

comparing the voltage corresponding to the current with the reference voltage; inputting a difference between the voltages to the signal correction control unit; and controlling the signal driving circuit on the basis of the voltage difference to correct the deterioration of the pixels.

9. A method of correcting the deterioration of pixels of an imaging device, the imaging device including: a display unit that includes a display area in which a plurality of pixels composed of self-emission elements and detection switches are arranged in a matrix, a scanning circuit for display, a signal driving circuit, and a power supply circuit; a deterioration detecting and correcting unit that includes a scanning circuit for detection, detects a correction reference voltage and feeds back the detected value to the signal driving circuit to correct display signals to be transmitted to deteriorated pixels; and mode selector switch units that selectively connect the signal driving circuit and the deterioration detecting and correcting unit to the display area, the display unit including: selector switch lines and lighting switch lines that extend from the scanning circuit for display to the display area and select the pixels arranged in a row direction of the matrix; signal lines that extend from the signal driving circuit to the display area and supply a display signal voltage to the pixels arranged in a column direction of the matrix; and power lines that extend from the power supply circuit to the display area and supply a current to the pixels, and the deterioration detecting and correcting unit including: the scanning circuit for detection; detection control lines that extend from the scanning circuit for detection to the display area and select the pixels arranged in the row direction of the matrix; a current source; a detection line that connects a node between the current source and the switch to the mode selector switch units; and a signal correction control unit that applies, to the signal driving circuit, signals for correcting the deterioration of the display signals supplied to the pixels on the basis of detection signals transmitted through the detection line, the method comprising:

in an image display mode of the display unit, operating the mode selector switch units to connect the signal lines to the signal driving circuit, thereby supplying the display signals from the signal driving circuit to the pixels to display an image;

in a pixel deterioration detecting/correcting mode of the display unit, in a vertical blanking period of the display signal, operating the mode selector switch units to connect the signal lines to the current source, thereby supplying a constant current from the current source to one of the pixels selected by the scanning circuit for detection;

detecting a voltage corresponding to the current as a reference voltage;

sequentially supplying the constant current from the current source to the pixels selected by the scanning circuit for detection;

turning on the detection switch of the selected pixels so as to connect the self-emission elements with corresponding one of the signal lines;

detecting a voltage corresponding to the current;

comparing the voltage corresponding to the current with the reference voltage;

inputting a difference between the voltages to the signal correction control unit; and controlling the signal driving circuit on the basis of the voltage difference to correct the deterioration of the pixels.

* * * * *